United States Patent [19]

Bessinger

[11] Patent Number: 4,691,887

[45] Date of Patent: Sep. 8, 1987

[54] SHELF ANCHOR

[75] Inventor: Walter L. Bessinger, Grand Haven, Mich.

[73] Assignee: Knape & Vogt Manufacturing Co., Grand Rapids, Mich.

[21] Appl. No.: 895,297

[22] Filed: Aug. 11, 1986

[51] Int. Cl.[4] ..... A47B 96/06

[52] U.S. Cl. ..... 248/250; 108/108; 108/152; 211/90

[58] Field of Search ..... 248/250, 235; 211/90; 108/27, 114, 152, 151, 108

[56] References Cited

U.S. PATENT DOCUMENTS

| | | | |
|---|---|---|---|
| 3,034,757 | 5/1962 | Suben | 211/90 X |
| 4,385,565 | 5/1983 | Roberts et al. | 248/235 X |
| 4,508,301 | 4/1985 | Nicholson et al. | 248/235 X |

FOREIGN PATENT DOCUMENTS

| | | | |
|---|---|---|---|
| 811370 | 8/1951 | Fed. Rep. of Germany | 211/90 |
| 1534774 | 7/1969 | Fed. Rep. of Germany | 52/290 |
| 1400793 | 7/1969 | Fed. Rep. of Germany | 248/250 |
| 2749477 | 5/1979 | Fed. Rep. of Germany | 248/235 |
| 2155310 | 9/1985 | United Kingdom | 312/205 |

*Primary Examiner*—J. Franklin Foss
*Assistant Examiner*—David L. Talbott
*Attorney, Agent, or Firm*—Price, Heneveld, Cooper, DeWitt & Litton

[57] ABSTRACT

There is disclosed a cantilever shelf support having a bracket with a laterally oriented throat to receive the rear portion of a shelf, the throat having a lower support platform, an upper overhang, and an inner end, a resilient insert in the throat, the insert having depending fingers resiliently flexible by an inserted shelf, a depending compression pad deeper in said throat than the fingers for supporting the inserted shelf, and a resilient skirt depending in front of the throat inner end for protective abutment with the rear edge of the shelf.

10 Claims, 9 Drawing Figures

SHELF ANCHOR

BACKGROUND OF THE INVENTION

This invention relates to cantilever shelf brackets.

Cantilever shelf brackets for supporting inserted shelf panels, usually of wood, have been known for many years. In recent years, these have taken the form of extruded aluminum devices capable of recieving the shelf panel in a wedging action, as in U.S. Pat. Nos. 4,508,301 and 4,385,565. That is, the wood shelf panel of closely controlled thickness tolerance is placed under slightly deforming wedging stress during insertion, for secure retention of the assembled panel structure. The panel is inserted until the inner end abuts the inner end of the bracket throat. While this works very well for certain materials such as wood or particle board, it is not desirable to apply such stresses to certain other materials, particularly glass or marble. Breakage can result. This potential breakage problem is accentuated by the fact that glass panels for shelving tend to vary considerably in thickness. Therefore, a thicker panel either will not fit within the throat of the bracket, or, if sufficient force is applied to wedge it in place, the stress is immediately too great. If a thin panel is inserted, it is not securely retained. Furthermore, the potential of breakage resulting from this stress is increased if any scratching of the glass occurs. One signifiant cause of such scratching is the abutment engagement of the inner edge of the inserted shelf with the inner end of the bracket throat or of the bracket fastener as during insertion of the panel. Alternatively, scratching can occur during the wedging type insertion of the glass panel into the metal bracket.

Aside from protecting glass and marble panels or the like from scratching, marring and localized stress, it is sometimes desirable to protect panels of fine wood and other materials during assembly of the shelving structure.

SUMMARY OF THE INVENTION

A primary object of this invention is to provide a cantilever shelf bracket capable of recieving and retaining a shelf panel, even of glass or marble, without scratching, marring or application of localized stress to the panel upon assembly. The support bracket has a laterally oriented receiving throat containing a resilient insert which has depending flexible fingers capable of inward upward deflection in varying amounts upon insertion of a shelf panel. It can even accommodate and retain glass panels of varying thickness. The insert has an inner skirt in front of the inner end of the bracket throat for abutment by the inserted shelf panel inner edge and prevention of abutment of the shelf edge with the inner end of the metal bracket throat or of the bracket fastener. The insert preferably has a depending compression support bumper deeper in the throat than the fingers, but not as deep as the skirt. The bracket with insert will also accept panels of other materials such as wood.

These and other related objects, advantages and features of this invention will become apparent upon review of the following specification in conjunction with the drawings.

DESCRIPTION OF THE PREFERRED EMBODIMENT

Figure 4:
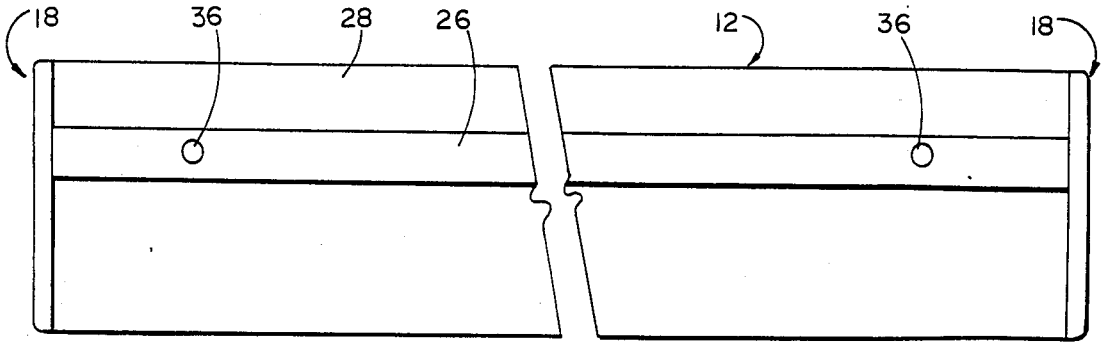
FIG. 4 is a front elevational view of the bracket without the insert but with end caps applied.

Referring now specifically to the drawings, and the illustrative embodiment depicted therein, the shelf and bracket assembly 10 includes a bracket assembly 12 having a polymeric insert 14, and cooperative with the rear portion of a shelving panel 16 here shown to be of glass. Preferably the ends of the bracket are covered by a pair of end caps 18 (FIG. 4).

Figure 2:
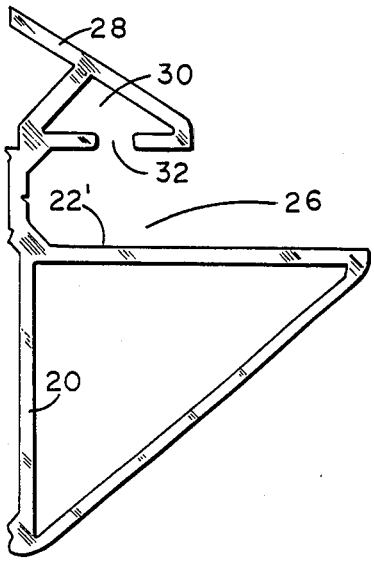
FIG. 2 is an end elevational view of the metal bracket without the insert.
Figure 3:
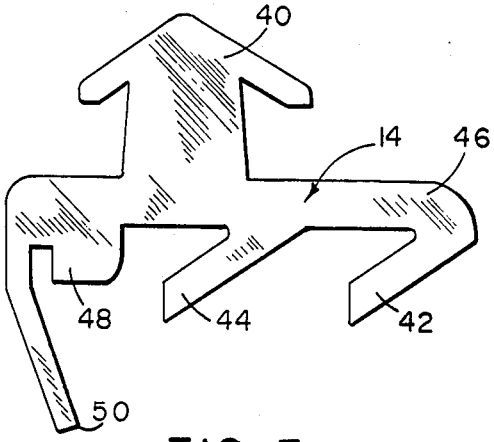
FIG. 3 is an enlarged end elevational view of the polymeric insert.

The bracket 12 itself preferably comprises an elongated metal member formed as by extrusion of aluminum. Between the upper overhang portion and the lower platform portion of the bracket is a receiving throat. The lower portion is illustrated as basically triangular in configuration, having a vertical rear panel 20 for abutment with the wall, and an upper horizontal forwardly extending panel 22 forming an upper support platform 22' at the bottom of the throat 26 (FIG. 2). This bottom portion is preferably hollow and can be used for a wiring conduit or the like.

Figure 1:
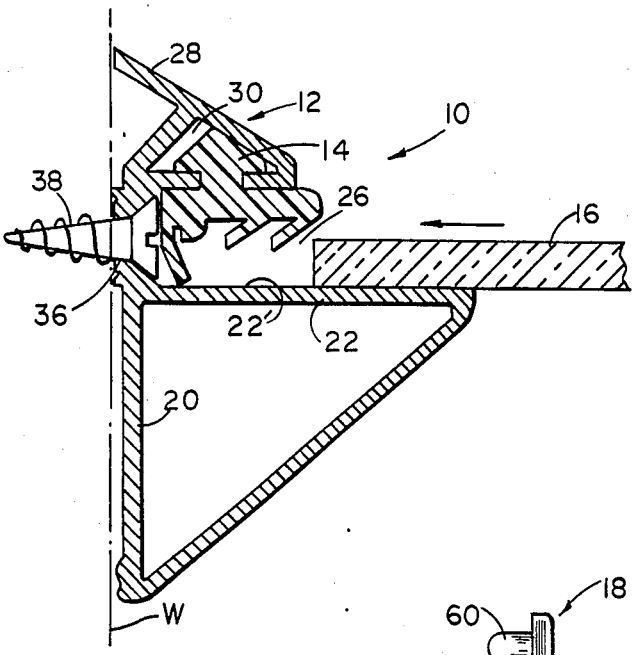
FIG. 1 is a side elevational sectional view of the novel bracket with insert, showing insertion of a glass shelf panel.
Figure 6:
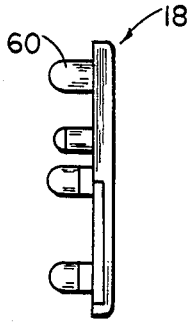
FIG. 6 is a front elevational view of an end cap.
Figure 5:
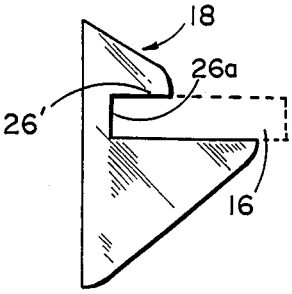
FIG. 5 is an end elevational view of an end cap, and showing a portion of a shelf in phantom.

The top portion of the bracket preferably has a diagonally upwardly rearwardly oriented fascia 28 for decorative purposes, and defines a hollow interior 30 shown to be triangular in configuration. In the embodiment depicted, it has one or more openings 32 in the bottom thereof, i.e., in the top of throat 26, for receipt of bayonet type fasteners or the equivalent on the upper portion of insert 14 for securement of the insert to the bracket. At the inner end of throat 26, i.e., adjacent the wall surface W to which the bracket is to be mounted, is a plurality of openings 36 (FIGS. 1 and 4) for insertions of threaded fasteners such as screws 38 or the like for securement of the bracket to the wall.

The insert 14 is of a resilient polymeric material, preferably polyvinylchloride or the equivalent, formed as by extrusion in a long strip. Extending upwardly from this extrusion is depicted a bayonet type fastener 40 with opposite flexible ears to allow insertion through orifices 32, whereupon the ears expand to provide a snug fit of the insert against the top of the throat. This bayonet fastening means is not considered novel with applicant and is not part of the invention herein. Alternative fastening could be employed in lieu thereof, e.g., adhering or bonding of the insert to the bracket surface, with or without use of other types of integral or attached fasteners, etc.

Depending downwardly from the forward portion of the insert are novel elongated flexible fingers 42 and 44 shown to be two in number in this illustrative embodiment. These depend from the horizontal body 46 of the insert, one finger at the front edge thereof and the other finger spaced therebehind. These fingers extend downwardly and rearwardly in their free form, in the preferred embodiment depicted, and are flexible in an arc, i.e., inwardly and upwardly, upon insertion of panel 16. The inherent resilience and memory of the polymer cause the deformed fingers to apply a downward retention force to the top surface of the panel. Any movement of the panel in the outward direction is frictionally resisted by the fingers. That is, the lower edge of the finger grips creates a linear force on the finger, tending to bow the finger down into greater engagement with the panel for increased resistance to removal of the panel.

The amount of arcuate flexure of the fingers during panel insertion depends upon the thickness of the panel inserted. These fingers enable the bracket to accommodate panels of varying thickness, such that the normal tolerance variations in glass panel materials, for example, can be readily accommodated.

Figure 7:
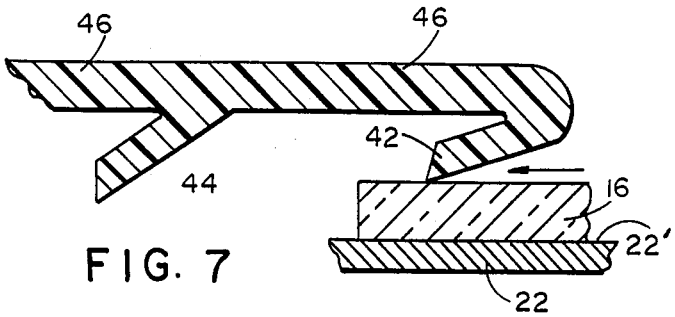
FIG. 7 is a greatly enlarged, side elevational, sectional fragmentary view of the two resilient fingers of the depicted insert, during insertion of a glass shelf panel.

Referring to FIG. 7, as panel 16 is inserted, supported by platform surface 22', it first encounters the forward flexible finger 42 to deflect it rearwardly and upwardly. It subsequently encounters inner finger 44 and deflects it rearwardly and upwardly in like fashion. Further insertion of the panel, if it is of ordinary thickness, causes it to engage beneath the lower surface of a depending compression pad 48 integral with the insert body 46. This pad is rearward of the fingers and preferably extends the length of the insert. Rearwardly of this comression pad is a flexible depending apron 50 integral with the insert body. In its free form, it extends downwardly and forwardly at a small acute angle, protruding downward to the vicinity of the platform 22'. Complete insertion of panel 16 flexes apron 50 toward the rear to a generally vertical orientation in abutment with the rear edge of panel 16 and shielding the panel edge from engagement with the metal inner end of throat 26 of the bracket or of engagement with threaded fastener screws 38. The soft polymeric material thereby protects the panel from scratching at this inner edge as well as along the top of the panel.

Figure 9:
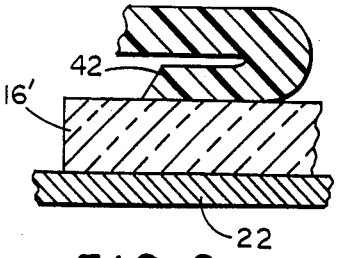
FIG. 9 is a side elevational, greatly enlarged, sectional fragmentary view of one of the resilient fingers during insertion of a thicker glass panel.
Figure 8:
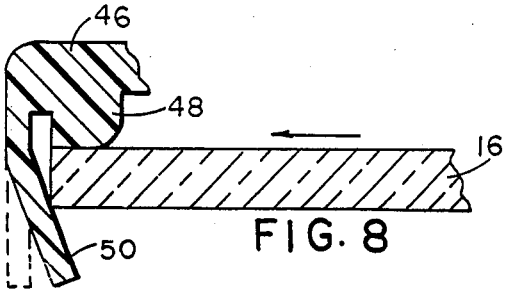
FIG. 8 is a greatly enlarged, side elevational, sectional fragmentary view of a portion of the insert during the final stages of shelf insertion.

If a panel of thicker dimension is inserted, (see FIG. 9), the panel 16' flexes the fingers, e.g. 42, further upwardly as depicted. Yet the insert accommodates it. The thickness of this shelf panel would be greater than the vertical spacing between pad 48 and platform 22' so that the inner edge of the shelf will simply abut the front face of the pad upon full insertion.

The flexible fingers depend a fraction of the distance toward platform 22', i.e., to a position where the lower edges thereof are at a spacing above platform 22', less than the thickness of the panel to be inserted. The lower surface of compression pad 48 is at an elevation above the lower edge of the fingers so that it is spaced above platform 22' an amount slightly greater than the thickness of the panel to be inserted. These fingers, pad and apron preferably extend longitudinally the entire length of the insert, which preferably extends the entire length of the metal extrusion. Alternatively, the fingers and/or pad and/or apron could be in segments, at intervals, and the insert could be in segments, if desired. Normally the bracket extends the full length of the shelf. However, the bracket could also be in multiple parts of short sections, at spaced intervals, if desired.

The end caps are preferably made of a polymeric material which is slightly resilient but generally rigid, e.g., an acetal material or the equivalent. These end caps have a throat 26' which is aligned with the larger throat 26 of the bracket. The end caps may include suitable pegs 60 or the like for frictional engagement in openings in the ends of the bracket, e.g., in the apices of the triangular portions thereof, for retention. Alternative fastenings may be used. In some instances no end caps at all need be used. Preferably inner ends **26*a*** of the throat can serve as an abutment surface for the inner edge of the shelving panel, if the panel has a length slightly greater than the length of the bracket.

It is conceivable that certain minor variations in the construction depicted as illustrative may be made without departing from the inventive concept presented herein. Hence, the invention is intended to be limited only by the scope of the appended claims and the reasonably equivalent structures to those defined therein, rather than to the preferred embodiment depicted as illustrative.

The embodiments of the invention in which an exclusive property or privilege is claimed are defined as follows.

1. A cantilever shelf support for a shelf having a rear portion and a rear edge, comprising:

a bracket having a laterally oriented throat to receive the rear portion of a shelf;

said throat having a lower support platform forming a bottom, an upper overhang forming a top, and an inner end;

a resilient insert in said throat;

said insert having depending finger means extending downwardly toward said platform and being resiliently flexible inwardly of said throat for engagement thereof, and inward flexure thereof, by an inserted rear portion of a shelf;

said insert having depending compression pad means in said throat for supporting abutment with the inserted shelf; and said insert having a resilient apron depending in front of said throat inner end for protective abutment with the rear edge of the shelf.

2. A cantilever shelf support for a shelf having a rear portion and a rear edge, comprising:

a bracket having a laterally oriented throat to receive the rear portion of a shelf;

said throat having a lower support platform forming a bottom, an upper overhang forming a top, and an inner end;

elongated depending finger means in said throat extending downwardly toward said platform and inwardly toward said inner end of said throat in the free form thereof, and being resiliently flexible inwardly and upwardly of said throat in an arc for engagement and inward-upward flexure thereof by an inserted rear portion of a shelf; said fingers having frictional character responsive to withdrawl movement of a shelf from said throat to bow said finger means down into greater engagement with the shelf for increased resistance to further removal of the shelf.

3. The shelf support in claim 2 wherein said insert has depending compression pad means in said throat inwardly of said elongated fingers for supporting abutment with the inserted shelf.

4. A cantilever shelf support for a shelf having a rear portion and a rear edge, comprising:

a bracket having a laterally oriented throat to receive the rear portion of a shelf;

said throat having a lower support platform forming a bottom, an upper overhang forming a top, and an inner end;

a resilient insert in said throat;

said insert having depending finger means extending downwardly toward said platform and being resiliently flexible inwardly of said throat for engagement thereof, and inward flexure thereof, by an inserted rear portion of a shelf;

said insert having a resilient apron depending in front of said throat inner end for protective abutment with the rear edge of the shelf.

5. A cantilever shelf support for a shelf having a rear portion and a rear edge, comprising:

a bracket having a laterally oriented throat to receive the rear portion of a shelf;

said throat having a lower support platform forming a bottom, an upper overhang forming a top, and an inner end;

a resilient insert in said throat;

said insert having a resilient skirt depending in front of said throat inner end for protective abutment with the rear edge of the shelf.

6. The shelf support in claim 5 wherein said insert has depending finger means extending downwardly toward said platform and resiliently flexible inwardly of said throat for engagement thereof, and inward flexure thereof, by an inserted rear portion of a shelf; and said insert has depending compression pad means in said throat behind said finger means and in front of said skirt for supporting abutment with the inserted shelf.

7. A cantilever shelf support for a shelf having a rear portion and a rear edge, comprising:

a bracket having a laterally oriented throat to receive the rear portion of a shelf;

said throat having a lower support platform forming a bottom, an upper overhang forming a top, and an inner end;

depending finger means extending downwardly in said throat toward said platform and being resiliently flexible inwardly of said throat for engagement and inward and upward flexure thereof by an inserted rear portion of a shelf; and a resilient apron in front of said throat inner end for protective abutment with the rear edge of the shelf.

8. The shelf support in claim 7 including depending compression pad means in said throat for supporting abutment with the top of the rear portion of an inserted shelf.

9. A cantilever shelf support for a shelf having a rear portion and a rear edge, comprising:

a bracket having a laterally oriented throat to receive the rear portion of a shelf;

said throat having a lower support platform forming a bottom, an upper overhang forming a top, and an inner end;

resilient abutment means in said throat in said top for engagement with the top of an inserted shelf; and a resilient abutment means in front of said throat inner end for protective abutment with the rear edge of the shelf.

10. The shelf support in claim 9 including depending finger means extending downwardly toward said platform and resiliently flexible inwardly of said throat for engagement and inward flexure thereof by an inserted rear portion of a shelf; and depending compression pad means in said throat behind said finger means and in front of said abutment means for supporting abutment with the inserted shelf.

* * * * *